US005964604A

United States Patent [19]

Kashiyama et al.

[11] Patent Number: 5,964,604

[45] Date of Patent: Oct. 12, 1999

[54] LIF CONNECTOR

[75] Inventors: Motohisa Kashiyama; Hiroshi Aoki, both of Shizuoka, Japan

[73] Assignee: Yazaki Corporation, Tokyo, Japan

[21] Appl. No.: 09/022,380

[22] Filed: Feb. 12, 1998

[30] Foreign Application Priority Data

Feb. 17, 1997 [JP] Japan ..... 9-031840

[51] Int. Cl.[6] ..... H01R 13/62

[52] U.S. Cl. ..... 439/157; 439/345; 439/372

[58] Field of Search ..... 439/152–160, 439/342, 345, 347, 372

[56] References Cited

U.S. PATENT DOCUMENTS

| | | | |
|---|---|---|---|
| 5,641,293 | 6/1997 | Tsuji et al. | 439/157 |
| 5,676,556 | 10/1997 | Yamaguchi et al. | 439/157 |
| 5,727,959 | 3/1998 | Yagi et al. | 439/342 |
| 5,839,912 | 11/1998 | Schckalla et al. | 439/157 |

FOREIGN PATENT DOCUMENTS

| | | |
|---|---|---|
| 4319271 | 11/1992 | Japan . |
| 611275 | 2/1994 | Japan . |
| 6140095 | 5/1994 | Japan . |
| 6215827 | 8/1994 | Japan . |
| 7169529 | 7/1995 | Japan . |
| 7307138 | 11/1995 | Japan . |

*Primary Examiner*—Lincoln Donovan
*Attorney, Agent, or Firm*—Sughrue, Mion, Zinn, Macpeak & Seas, PLLC

[57] ABSTRACT

Pivot shafts are formed on a female connector, and male and female connectors are fitted together by pivotally moving an operating lever pivotally mounted on the pivot shafts. The operating lever has shaft-receiving grooves for respectively receiving the pivot shafts, and includes retaining portions formed integrally with this operating lever, and each of the retaining portions has a flat or curved abutment surface which is in line-contact with the associated pivot shaft received in the shaft-receiving groove, thereby retaining the pivot shaft in the shaft-receiving groove.

13 Claims, 5 Drawing Sheets

LIF CONNECTOR

BACKGROUND OF THE INVENTION

This invention relates to an LIF (Low Insertion Force) connector having an operating lever by which male and female connectors each having a plurality of terminals can be easily connected together and disconnected from each other.

One example of conventional LIF connectors having an operating lever is disclosed in Japanese Patent Unexamined Publication No. Hei. 7-307183.

FIGS. 4(*a*) and 4(*b*) are side views of this conventional LIF connector, showing its construction and operation.

In FIG. 4(*a*), a female connector 110 includes a housing 111 having a reception portion 112 for receiving a male connector 120. Horizontal grooves 113 are formed respectively through opposite side walls of the reception portion 112, and a pivot shaft 114 is formed on each of these opposite side walls, and is disposed rearwardly of the horizontal groove 113.

Guide projections 122 for being fitted respectively into the horizontal grooves 113 in the female connector 110 are formed on a housing 121 of the male connector 120.

An operating lever 130 has a U-shaped cross-section, and shaft-receiving grooves 131 are formed respectively through opposite side walls of this operating lever 130, and each of the shaft-receiving grooves 131 has a semi-circular inner (terminal) end for receiving the associated pivot shaft 114 of the female connector 110.

The pivot shafts 114 of the female connector 110 are fitted respectively into the shaft-receiving grooves 131 in the operating lever 130, and then a retaining portion 132 is secured to an inlet portion of each of the shaft-receiving grooves 131, so that the pivot shaft 114 is retained by a semi-circular abutment surface 132*a* of the retaining portion 132. In this manner, the operating lever 130 is pivotally mounted on the female connector 110.

An arcuate groove 133 is formed in an inner surface of each of the opposite side walls of the operating lever 130, and the arcuate groove 133 guides the associated guide projection 122 of the male connector 120, received in the horizontal groove 113 in the female connector 110, toward the inner end of this horizontal groove 113.

In the conventional LIF connector of this construction, first, the horizontal grooves 113 in the female connector 110 are positioned respectively with respect to the arcuate grooves 133 in the operating lever 130 in such a manner that the inlet of each horizontal groove 113 coincides with the associated arcuate groove 133, as shown in FIG. 4(*a*).

In this condition, the male connector 120 is provisionally inserted into the reception portion 112 of the female connector 110, and the guide projections 122 of the male connector 120 are guided respectively into the arcuate grooves 133 through the respective horizontal grooves 113. Then, the operating lever 130 is pivotally moved in a direction of arrow P (FIG. 4(*a*)).

As a result, each of the guide projections 122 is guided toward the inner ends of the associated horizontal groove 113 and arcuate groove 133, and is held in the aligned inner ends of these grooves, as shown in FIG. 4(*b*). As a result, the male connector 120 is completely inserted into the reception portion 112, and is fitted in the female connector 110.

However, in the above conventional LIF connector, the abutment surface 132*a* of the retaining portion 132 has an arcuate shape as shown in FIG. 5, and therefore the opposite ends (indicated by dots-and-dash lines in FIG. 5) of this arcuate surface are tapering, and are reduced in strength, and therefore there has been a problem that the yield of the products is low.

Another problem is that those portions (indicated by dots-and-dash lines in FIG. 5) of a mold 140 (used for molding the retaining portion 132), corresponding respectively to the opposite ends of the arcuate abutment surface 132*a*, are also reduced in strength.

Furthermore, since the abutment surface 132*a* of the retaining portion 132 is formed into an arcuate shape, the area of contact between this abutment surface 132*a* and the cylindrical pivot shaft 114 is large, and an increased frictional resistance is produced when pivotally moving the operating lever 130, and therefore there has been a problem that a large force is required for operating the operating lever 130.

SUMMARY OF THE INVENTION

The present invention has been made in view of the above problems, and an object of the invention is to provide an LIF connector in which with a simple construction of the connector, the strength of retaining portions, as well as the strength of a mold for forming the retaining portions, is increased, and a force, required for operating an operating lever, is reduced.

The above object has been achieved by an LIF connector according to a first aspect of the invention wherein pivot shafts are formed on one of a pair of male and female connectors, and the two connectors are fitted together by pivotally moving an operating lever pivotally mounted on the pivot shafts, and the operating lever has shaft-receiving grooves for respectively receiving the pivot shafts, and includes retaining portions, each of the retaining portions having a flat or curved abutment surface which is brought into line-contact with the associated pivot shaft received in the shaft-receiving groove, thereby retaining the pivot shaft in the shaft-receiving groove.

In this construction, the abutment surface of each of the retaining portions is formed into a flat or curved surface for line-contact with the pivot shaft, and therefore tapering end portions as in the conventional retaining portion are eliminated. Therefore, the strength of the retaining portion is increased, and also the strength of a mold for forming the retaining portion is increased.

The abutment surface of the retaining portion retains the pivot shaft while being in line-contact with the pivot shaft, and therefore the area of contact of the abutment surface is small. Therefore, a frictional resistance, developing between the abutment surface and the pivot shaft when pivotally moving the operating lever, is reduced, and therefore the force, required for operating the operating lever, is reduced.

According to the LIF connector of a second aspect of the invention, in the LIF connector of the first aspect, the retaining portions are formed integrally with the operating lever, and are disposed adjacent respectively to inlet portions of the shaft-receiving grooves.

With this construction, the operating lever can be formed into a single integral part, and the construction can be simplified. And besides, the time and labor, required for mounting the retaining portions as in the conventional construction after fitting the pivot shafts respectively into the shaft-receiving grooves, are saved, and by merely fitting the pivot shafts into the shaft-receiving portion, the pivot shafts can be retained with a one-touch operation.

DETAILED DESCRIPTION OF THE INVENTION

One preferred embodiment of an LIF connector of the present invention will now be described with reference to the drawings.

Figure 1:
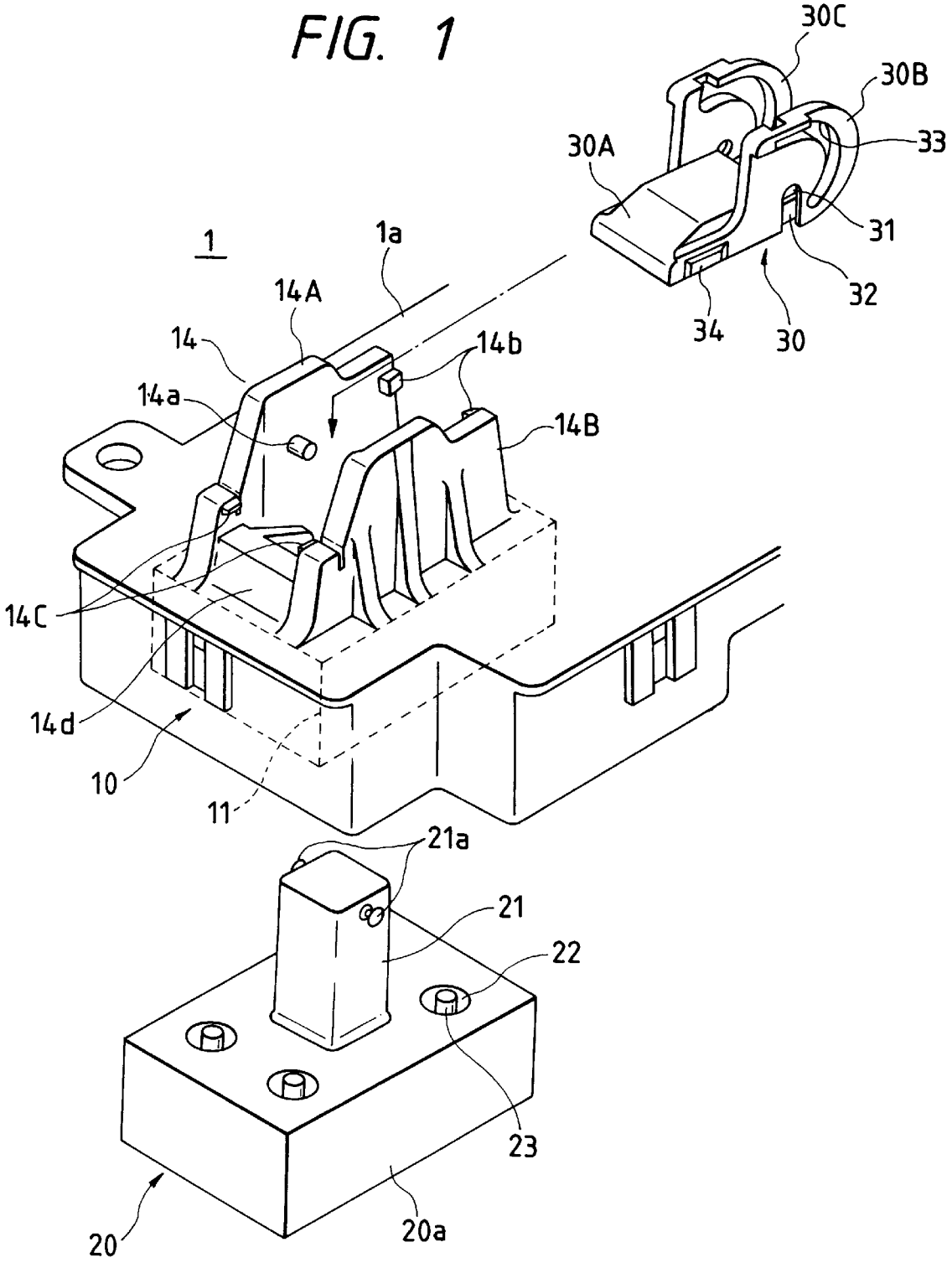
FIG. 1 is an exploded, perspective view of one preferred embodiment of an LIF connector of the present invention.
Figure 2:
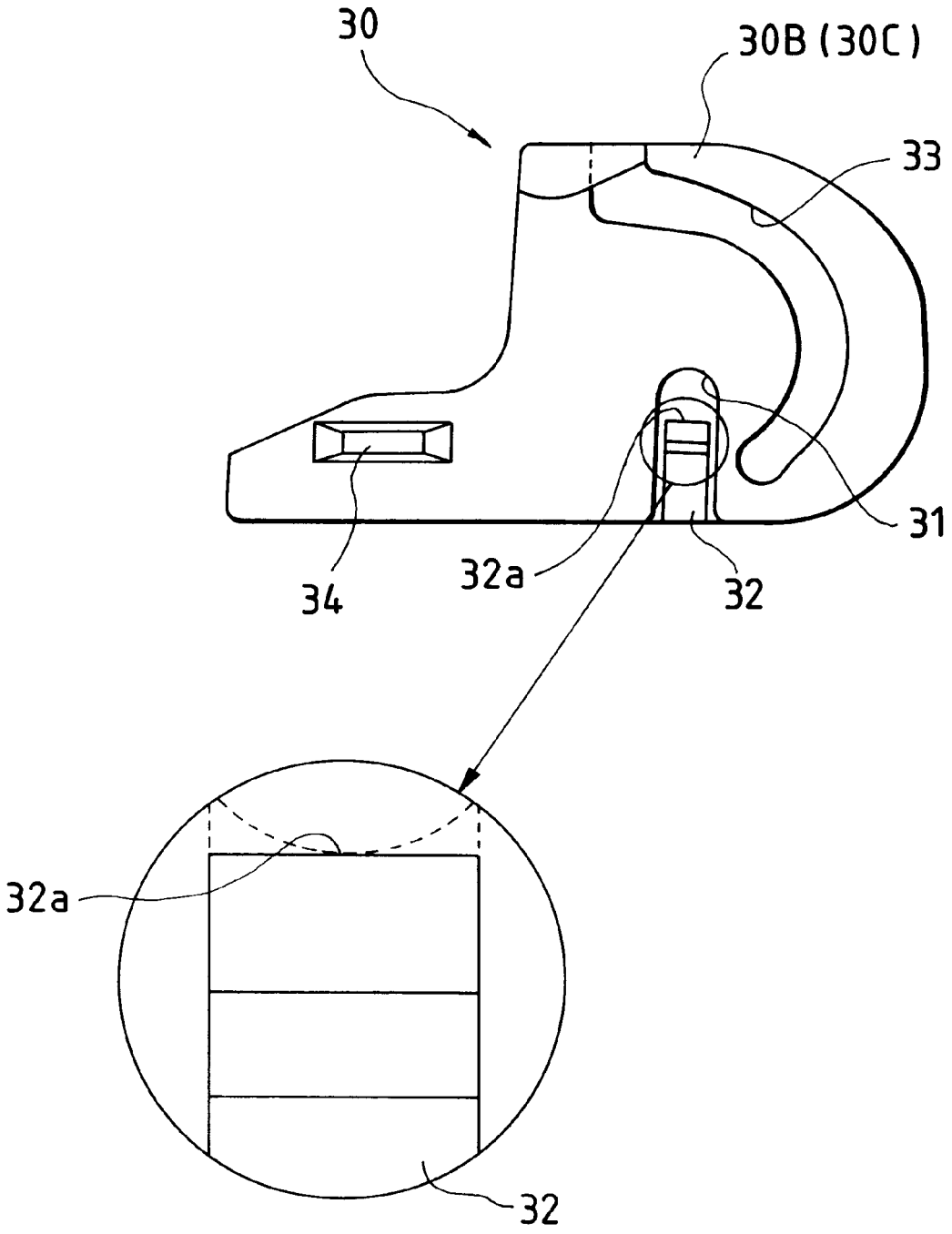
FIG. 2 is a side view of an operating lever of the LIF connector.
Figure 3A:
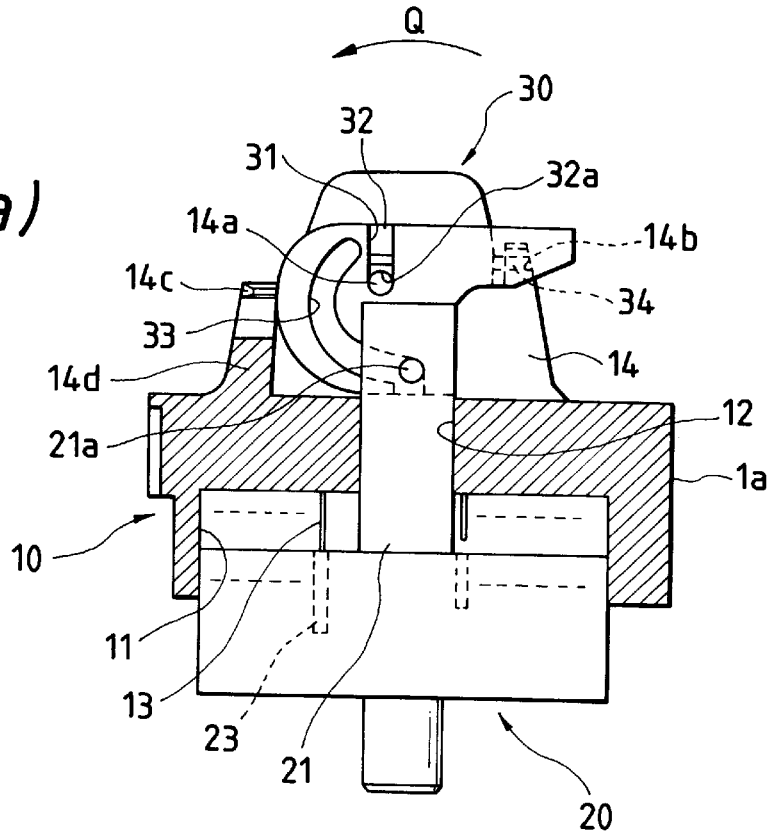
FIGS. 3(*a*) and 3(*b*) are partially cross-sectional views showing an operation of fitting male and female connectors of the LIF connector together.
Figure 3B:
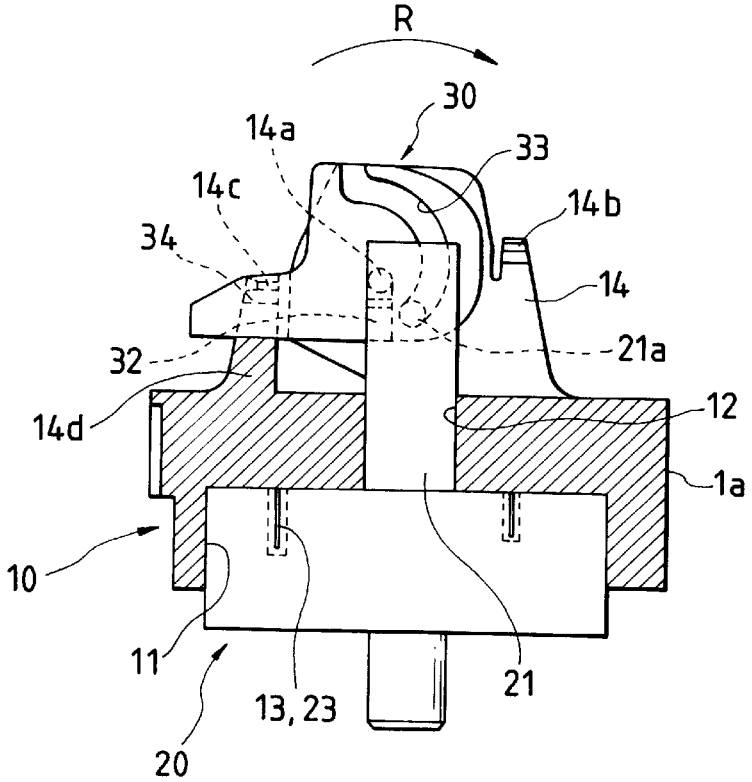
Figure 4A:
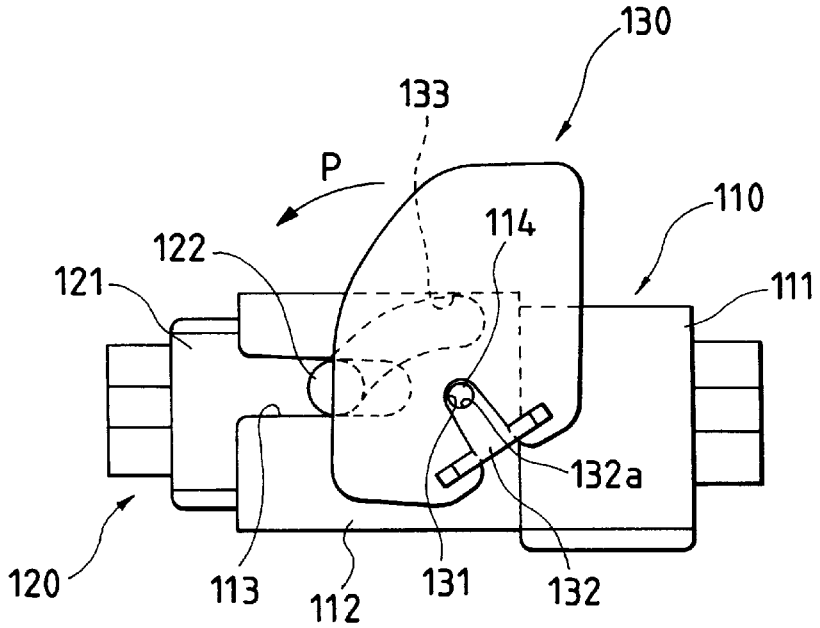
FIG. 4(a) PRIOR ART
FIGS. 4(*a*) and 4(*b*) are side views showing the construction and operation of a conventional LIF connector.
Figure 4B:
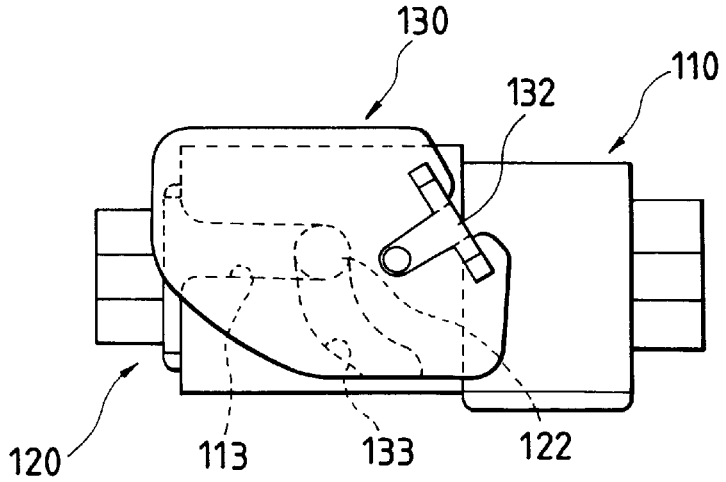
FIG. 4(b) PRIOR ART
Figure 5:
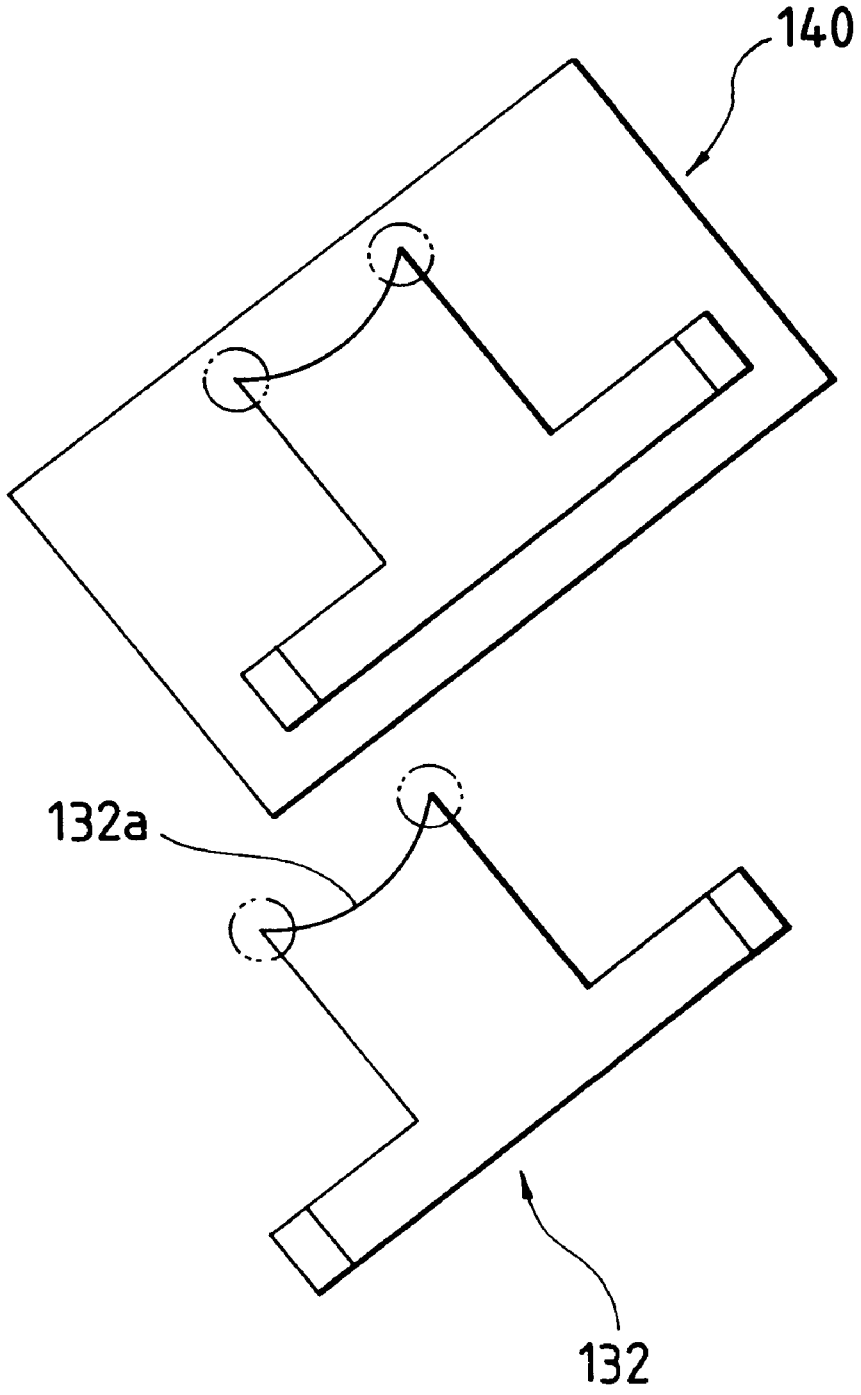
FIG. 5 PRIOR ART
FIG. 5 is a plan view showing a retaining portion of an operating lever of the conventional LIF connector, as well as a mold for forming this retaining portion.

FIG. 1 is an exploded, perspective view one preferred embodiment of the LIF connector of the invention, FIG. 2 is a side view of an operating lever of the LIF connector, and FIGS. 3(*a*) and 3(*b*) are partially cross-sectional views showing an operation of fitting male and female connectors of the LIF connector together.

In FIG. 1, the LIF connector of this embodiment comprises a female connector 10 formed integrally with a housing 1*a* of a junction box (electric connection box) 1, a male connector 20 to be inserted into a reception portion 11 of the female connector 10, and an operating lever 30 pivotally mounted on the housing 1*a*.

As shown in FIGS. 1 and 3, the female connector 10 includes the rectangular reception portion 11 for receiving the male connector 20, and a through hole 12 of a rectangular cross-section is formed through an upper wall of the housing 1*a*, and communicates with the reception portion 11. A plurality of male terminals 13 project into the interior of the reception portion 11.

Although not shown in the drawings, the male terminals 13 are connected integrally to bus bars mounted in the housing 1*a*.

A pedestal 14 is formed integrally on an upper surface of the housing 1*a* in surrounding relation to the through hole 12. The pedestal 14 is constituted mainly by opposed side walls 14A and 14B, and a pivot shaft 14*a* is formed on a central portion of each of the opposed side walls 14A and 14B. A lock pawl 14*b* and a lock pawl 14*c* are formed respectively at opposite end portions of each of the opposed side walls 14A and 14B between which the pivot shaft 14*a* is disposed.

A stopper 14*d* is formed below the lock pawls 14*c*, and interconnects the opposed side walls 14A and 14B.

The male connector 20 includes a rectangular housing 20*a* corresponding to the reception portion 11 of the female connector 10, and a driven shaft 21, corresponding to the through hole 12 in the female connector 10, is formed upright on an upper surface of the housing 20*a*. Guide projections 21*a* are formed respectively on opposite sides of the driven shaft 21 at an upper end portion thereof.

A plurality of cavities 22 are formed in an upper portion of the housing 20*a*, and a plurality of female terminals 23 for respectively receiving the male terminals 13 of the female connector 10 are received respectively in the cavities 22.

As shown in FIG. 1, the operating lever 30 includes a grip portion 30A, and side walls 30B and 30C integrally formed respectively on opposite sides of the grip portion 30A.

The grip portion 30A is gripped by the operator when pivotally moving the operating lever 30, and the grip portion 30A has a suitable thickness and a slanting portion so that it can be easily gripped.

As shown in FIG. 2, a straight shaft-receiving groove 31 and an arcuate cam groove 33 are formed through each of the side walls 30B and 30C.

The shaft-receiving grooves 31 correspond respectively to the pivot shafts 14*a* formed on the pedestal 14 of the female connector 10 shown in FIG. 1, and a starting end of each shaft-receiving groove 31 serves as an inlet for the associated pivot shaft 14*a*, and its inner (terminal) end is formed into a semi-circular shape substantially equal in diameter to the pivot shaft 14*a*.

A pair of elastic retaining portions 32 are formed integrally on the operating lever 30, and are disposed adjacent respectively to the inlet portions of the shaft-receiving grooves 31. An abutment surface 32*a*, formed at a distal end of the retaining portion 32, is held against the outer peripheral surface of the pivot shaft 14*a*, thereby retaining the pivot shaft 14*a* at the inner end of the shaft-receiving groove 31.

As shown in an enlarged view in FIG. 2, the abutment surface 32*a* of the retaining portion 32 is flat, and does not have opposite tapering ends (indicated in phantom in FIG. 2) as in the arcuate abutment surface 132*a* of the conventional retaining portion, and the abutment surface 32*a* is brought into line-contact with the pivot shaft 14*a*.

The pivot shafts 14*a* are fitted respectively into the shaft-receiving grooves 31, and are retained respectively by the retaining portions 32, thus pivotally mounting the operating lever 30 on the pedestal 14 of the female connector 10.

The cam grooves 33 correspond respectively to the guide projections 21*a* formed on the driven shaft 21 of the male connector 20 shown in FIG. 1. A starting end of each of the cam grooves 33 serves as an inlet for the associated guide projection 21*a*, and its inner (terminal) end is formed into a semi-circular shape substantially equal in diameter to the guide projection 21*a*.

Plate-like projecting piece portions 34 are formed respectively on those portions of the side walls 30B and 30C corresponding to the grip portion 30A, and project outwardly.

When the operating lever 30 is pivotally moved an angle of 180 degrees in a direction of arrow R from a position of FIG. 3(*b* ) into a position of FIG. 3(*a*), the projecting piece portions 34 are retainingly engaged respectively with the lock pawls 14*b* formed on the pedestal 14. When the operating lever 30 is pivotally moved an angle of 180 degrees in a direction of arrow Q from the position of FIG. 3(*a*) into the position of FIG. 3(*b*), the projecting piece portions 34 are retainingly engaged respectively with the lock pawls 14*c* formed on the pedestal 14.

Next, the operation of connecting and disconnecting the male and female connectors of this LIF connector relative to each other will be described with reference to FIGS. 3(*a*) and 3(*b*).

When the male connector 20 is to be fitted into the female connector 10, the operating lever 30 is first pivotally moved in a direction opposite to the direction of arrow Q, so that the projecting piece portions 34 are retainingly engaged respectively with the lock pawls 14*b*, as shown in FIG. 3(*a*). As a result, the operating lever 30 is fixed, and the inlets of the cam grooves 33 in the operating lever 30 are positioned relative to the through hole 12 in the female connector 10.

Then, the male connector 20 is provisionally inserted into the reception portion 11 of the female connector 10, and the driven shaft 21 of the male connector 20 is projected from the through hole 12 in the female connector 10, and the guide projections 21*a* are positioned at the inlets of the cam grooves 33, respectively.

In this condition, the retaining engagement of each projecting piece portion 34 with the associated lock pawl 14*b* is released, and then when the operating lever 30 is pivotally moved in the direction of arrow Q, the guide projections 21*a* move respectively along the cam grooves 33, so that the male connector 20 is pulled toward the inner side of the reception portion 11 of the female connector 10.

Thereafter, simultaneously when each guide projection 21*a* reaches the inner end of the associated cam groove 33, the male connector 20 is completely inserted into the reception portion 11, and is fitted in the female connector 10, as shown in FIG. 3(*b*). In this condition, the female terminals 23 in the male connector 20 are electrically connected respectively to the male terminals 13 in the female connector 10.

At the same time, the grip portion 30A of the operating lever 30 is held against the stopper 14*d* on the pedestal 14, and also the projecting piece portions 34 are retainingly engaged respectively with the lock pawls 14*c*, thereby fixing the operating lever 30. As a result, the fitted condition of the male and female connectors 20 and 10 is maintained.

For disconnecting the male connector 10 from the female connector 20, the operating lever 30 is pivotally moved in a reverse direction, that is, in the direction of arrow R in FIG. 3(*b*), thereby returning the two connectors 10 and 20 to the condition of FIG. 3(*a*).

In the LIF connector of this embodiment, the abutment surface 32*a* of each of the retaining portions 32 of the operating lever 30 is formed into the flat surface for line-contact with the pivot shaft 14*a*, and with this construction, tapering end portions as in the abutment surface 132*a* of the conventional retaining portion 132 are eliminated. Therefore, the strength of the retaining portion 32 is increased, and also the strength of a mold for forming the retaining portions is increased.

The abutment surface 32*a* of the retaining portion 32 retains the pivot shaft 14*a* while being in line-contact with the pivot shaft 14*a*, and therefore the area of contact of the abutment surface 32*a* is small, and a frictional resistance, developing between the abutment surface 32*a* and the pivot shaft 14*a* when pivotally moving the operating lever 30, is reduced, and therefore the force, required for operating the operating lever 30, is reduced.

Namely, the male and female connectors 20 and 10 can be connected together and disconnected from each other with a smaller force.

The retaining portions 32 are formed integrally on the operating lever 30, and are disposed adjacent respectively to the inlet portions of the shaft-receiving grooves 31, and therefore the operating lever 30 can be formed into a single integral part, and the construction can be simplified.

In addition, the time and labor, required for mounting the retaining portions as in the conventional construction after fitting the pivot shafts 14*a* respectively into the shaft-receiving grooves 31, are saved, and with a one-touch operation, that is, merely by fitting the pivot shafts 14*a* respectively into the shaft-receiving grooves 31, the pivot shafts 14*a* can be retained.

The LIF connector of the invention is not limited to the above embodiment.

For example, the abutment surface 32*a* of the retaining portion 32 is not limited to a flat surface, but may be a curved surface such as a semi-circular shape and a semi-oval shape, as long as the abutment surface is brought into line-contact with the pivot shafts.

In the above embodiment, although the female connector 10 is formed integrally with the housing 1*a* of the junction box 1, the invention can be applied to the type of LIF connector comprising independent male and female connectors.

As described above, in the LIF connector of the present invention, with the simple construction, the strength of the retaining portions, as well as the strength of the mold for forming the retaining portions, is increased, and also the force, required for operating the operating lever, is reduced.

What is claimed is:

1. A low insertion force (LIF) connector comprising:

a male connector;

a female connector;

a plurality of pivot shafts disposed on at least one of said male and female connectors; and an operating lever pivotally mounted on said plurality pivot shafts, said male and female connectors being fitted together by pivotally moving said operating lever;

wherein said operating lever comprises:

a plurality of shaft-receiving grooves for respectively receiving said plurality of pivot shafts; and a plurality of separate retaining portions respectively disposed proximate to said plurality of shaft-receiving grooves and retaining said plurality of pivot shafts in said plurality of said shaft-receiving grooves, each of said retaining portions including an abutment surface which is in line-contact with an associated pivot shafts received in said plurality of shaft-receiving grooves.

2. A low insertion force (LIF) connector as claimed in claim 1, wherein said plurality of retaining portions are integral with said operating lever, and are disposed adjacent respectively to inlet portions of said plurality of shaft-receiving grooves.

3. A low insertion force (LIF) connector as claimed in claim 1, wherein said abutment surface is a flat surface.

4. A low insertion force (LIF) connector as claimed in claim 1, wherein said abutment surface is a curved surface.

5. A low insertion force (LIF) connector as claimed in claim 1, wherein said plurality of pivot shafts are disposed on said female connector.

6. A low insertion force (LIF) connector as claimed in claim 1, wherein said retaining portions are formed integrally on said operating lever and are disposed adjacent to inlet portions of said plurality of shaft-receiving grooves.

7. A low insertion force (LIF) connector comprising:

a male connector;

a female connector;

at least one pivot shaft disposed on at least one of said male and female connectors, and;

an operating lever pivotally mounted on said at least one pivot shaft, said male and female connectors being fitted together by pivotally moving said operating lever;

wherein said operating lever further comprises:

at least one shaft-receiving groove for respectively receiving said at least one pivot shaft; and a separate retaining portion which respectively retains said at least one pivot shaft in said at least one shaft-receiving groove, said retaining portion having an abutment surface oriented substantially perpendicular to said at least shaft-receiving groove, wherein said at least one pivot shaft is in line-contact with said abutment surface.

8. A low insertion force (LIF) connector as claimed in claim 7, wherein said abutment surface is a flat surface.

9. A low insertion force (LIF) connector as claimed in claim 7, wherein said abutment surface is a curved surface having a radius of curvature opposite in direction, relative to said line-contact, to that of said at least one pivot shaft.

10. A low insertion force (LIF) connector comprising:

a male connector;

a female connector;

at least one pivot shaft disposed on at least one of said male and female connectors, and;

an operating lever pivotally mounted on said at least one pivot shaft, said male and female connectors being fitted together by pivotally moving said operating lever;

wherein said operating lever further comprises:

at least one shaft-receiving groove for respectively receiving said at least one pivot shaft; and a separate retaining portion which retains said at least one pivot shaft in said at least one shaft-receiving groove, wherein said retaining portion includes an abutment surface located between side surfaces of said at least one shaft-receiving groove, wherein said abutment surface abuts against said at least one pivot shaft at an intersection of the respective said abutment surface and a surface of said at least one pivot shaft, and wherein said intersection is along a line of contact between said respective surfaces.

11. A low insertion force (LIF) connector as claimed in claim 10, wherein said abutment surface is a flat surface.

12. A low insertion force (LIF) connector as claimed in claim 10, wherein said abutment surface is a curved surface having a radius of curvature opposite in direction, relative to said line-contact, to that of said at least one pivot shaft.

13. A low insertion force (LIF) connector as claimed in claim 10, wherein said retaining portion is formed integrally on said operating lever and is disposed adjacent to inlet portions of said plurality of shaft-receiving grooves.

* * * * *